US006746264B1

(12) United States Patent
Branch et al.

(10) Patent No.: US 6,746,264 B1
(45) Date of Patent: Jun. 8, 2004

(54) PULL TYPE LATCH MECHANISM FOR REMOVABLE SMALL FORM FACTOR ELECTRONIC MODULES

(75) Inventors: Scott M. Branch, Rochester, MN (US); David P. Gaio, Rochester, MN (US); Michael F. Hanley, Rochester, MN (US); William K. Hogan, Rochester, MN (US)

(73) Assignee: JDS Uniphase Corporation, San Jose, CA (US)

( * ) Notice: Subject to any disclaimer, the term of this patent is extended or adjusted under 35 U.S.C. 154(b) by 532 days.

(21) Appl. No.: 09/669,624

(22) Filed: Sep. 25, 2000

(51) Int. Cl.[7] ..... H01R 13/627
(52) U.S. Cl. ..... 439/352; 439/358
(58) Field of Search ..... 439/352–358

(56) References Cited

U.S. PATENT DOCUMENTS 5,564,939 A * 10/1996 Maitani et al. ..... 439/352
5,632,641 A * 5/1997 Sobel ..... 439/352
5,651,690 A * 7/1997 Klas et al. ..... 439/352
5,779,495 A * 7/1998 Dechelette et al. ..... 439/353

* cited by examiner

*Primary Examiner*—Khiem Nguyen
(74) *Attorney, Agent, or Firm*—Allen, Dyer, Doppelt, Milbrath & Gilchrist, P.A.

(57) ABSTRACT

A latch is controlled to latch and unlatch a device by using a portion of the insertion and extraction movement of the device being latched. The latch incorporates a pivoted latching member carried on the device being latched. The end or latching surface is positionable behind a latch bar, preventing the extraction of the latched device. The latch member is displaced to latch or release by a spring disposed between the frame of the device being latched and the latch member. When the actuator member is withdrawn from its ineffective position and if the latch arm occupies a latched position, the actuator member engages surfaces on the latch member and the module frame which are too closely spaced to permit free passage of the engaging portion of the actuator. This engagement with the surfaces results in spreading the engaged portions of the module frame and the latch member, thereby pivoting the latch member to unlatch the latching end of the latch member from a retaining surface.

14 Claims, 5 Drawing Sheets

PULL TYPE LATCH MECHANISM FOR REMOVABLE SMALL FORM FACTOR ELECTRONIC MODULES

CROSS REFERENCE TO RELATED UNITED STATES PATENT APPLICATIONS

The following are related co-pending United States patent applications:

- REMOVABLE SMALL FORM FACTOR FIBER OPTIC TRANSCEIVER MODULE CHASSIS, Ser. No. 09/489,870, filed Jan. 20, 2000, by Scott M. Branch, David P. Gaio and William K. Hogan;
- REMOVABLE LATCH AND BEZEL EMI GROUNDING FEATURE FOR FIBER-OPTIC TRANSCEIVERS, Ser. No. 09/410,786, filed Oct. 1, 1999, by Scott M. Branch, David P. Gaio and William K. Hogan;
- REMOVABLE SMALL FORM FACTOR FIBER OPTIC TRANSCEIVER MODULE AND ELECTROMAGNETIC RADIATION SHIELD, Ser. No. 09/489,184. filed Jan. 20, 2000, by Scott M. Branch, David P. Gaio and William K. Hogan;
- PIVOTING TYPE LATCH FOR REMOVABLE ELECTRONIC DEVICES, Ser. No. 09/591,640 filed Jun. 9, 2000, by Scott M. Branch, Leland L. Day, David P. Gaio, Michael F. Hanley and William K. Hogan;
- PULL TYPE LATCH FOR REMOVABLE SMALL FORM FACTOR ELECTRONIC MODULES, Ser. No. 09/669,624, filed Sep. 25, 2000 by Scott M. Branch, David P. Gaio, Michael F. Hanley and William K. Hogan, which are incorporated herein in their entireties for purposes of disclosure by this reference.

FIELD OF THE INVENTION

This invention relates to the field of connecting cables or other devices to computers or other devices and, more specifically, to the latching of connectors and connections together to ensure reliable service and uninterrupted data transmission and reception.

BACKGROUND OF THE INVENTION

Increasingly, computers and servers are being interconnected with other computers and servers to form communications and data networks. Prodigious amounts of data and other communications are transmitted and received over such networks and require reliable connection of coaxial or fiber-optic cables to either the computer/server or interface devices connected to the computer/server in order to insure continued and uninterrupted connections. Networked computers or servers typically operate continuously, twenty four hours a day, to provide the services or data that a computer or server is expected to provide upon demand to the remote computers.

Easy connection/disconnection and reliable cable connections are necessary to permit rapid, easy and reliable changing of cables as needs arise. One approach, which is rapidly becoming a standard within the industry, utilizes a transceiver module to receive signals from the network cable and to transmit signals to the computer or server, or vice-versa.

This type transceiver module may be designed in various versions, but all are compatible with the particular connector and port in a particular computer or server. Some transceivers can receive optical signals and output electronic signals to the computer and vice-versa. Other transceiver modules may be designed to receive electronic signals from the network cables and output or transmit computer compatible electronic signal and vice-versa. Transceiver modules are inserted into and connected to the data ports of a computer or server. The transceiver modules must be reliably latched into data ports and reliably retained against reasonable forces exerted on cables to prevent unintended disconnection from the data ports. At the same time, the latching of the transceiver modules must not be so resistive to unintentional disconnection forces that the transceiver module is damaged if the cables are pulled excessively.

The latching devices preferably are disposed on the transceiver modules so that these latching devices are removed from the host device whenever the transceiver module is removed. Thus, the latch itself cannot be left in the data port, unprotected as such, and face the possibility of breakage from impacts or forces exerted thereon. Such breakage is a problem presented by designs wherein the latch mechanism is not removed from the data port whenever a transceiver module is removed. Remaining as part of the host device, a latch is obviously exposed to damage as it projects from the host device without a protective device to shield the latch device.

It is beneficial to be able to use the insertion motion and forces to insure that the latch engages and latches with the system housing or other latch surface. The spring action of the restore spring forces engagement of the latching surfaces of the latch arm and the system housing. Forces on the pull tab to unlatch and extract the transceiver module also provide the extraction force needed to remove the transceiver module from the port.

The latch is designed and created to be an intentionally "weak link" in the retention apparatus to desirably protect from destructive forces, the more expensive components, from destructive forces, such as a transceiver module; destructive forces include those exerted by a person tripping over the cables or pulling excessively hard on the cables. Thus the latch is breakable and must be easily replaced. Therefore, the latch must be simple in construction and easily disassembled and reassembled without or with the simplest of tools.

OBJECTS OF THE INVENTION

It is an object of the invention to latch a modular device into a predetermined position or receptacle relative to a host device.

It is another object to the invention to bias a latch to hold the latched device in a latched condition pending release of the latching mechanism and the unlatching motion and extraction of the device.

It is a further object of the invention to positively drive the latching mechanism in both an unlatching and a latching movement.

It is an additional object of the invention to effect latching of the latch mechanism as a part of an inserting motion.

It is still another object of the invention to effect unlatching as part of an extracting movement.

It is a still further object of the invention for the latch mechanism to be easily replaceable on the device being latched to the host device.

Other objects of the invention will become apparent from a complete understanding of the structural and operational aspects of the invention provided by the attached drawings and the Detailed Description of the Invention below.

SUMMARY OF THE INVENTION

The invention relates to a module carrying a latch mechanism embodying a pivoted latch member, the latch member preferably pivoted between two ends of the latch member. The latch member and/or the module frame are provided with wedge-shaped members projecting toward each other, restricting the width of the space between the module frame and the latch member. The wedge-shaped member or members on the latch member are positioned on the portion of the latch member separated from the latching end of the latch member by the pivot mounting. The displacement of the wedges on the latch member away from the module frame will result first in the pivotal retraction of the latching end toward the module frame and, secondly, will disengage the latching end from a retaining surface on the host device into which the module is latched.

The displacement of the wedges is effected by an actuator member which has at least a portion thereof positioned between the latch member and the module frame and is slidable therebetween. A portion of the actuator member may be sized to spread the wedges when the actuator member is displaced along a direction which is substantially parallel to the direction or axis of insertion or extraction of the module relative its connected host device.

When the actuator member is pushed inwardly in the insertion direction and if the latch member is not biased to engage a retaining surface, the actuator member acts to spread the latch end of the latch member from the frame of the module and force the latch end into a position interfering with the retaining surface and thus latch the module into the host device. The amount of displacement of the actuator member to effect unlatching may be reduced by providing opposing wedges on both the module frame and the proximate portion of the latch member with the wedges projecting toward the other latch member or frame.

A more complete understanding of the structure and operation of the latching mechanism of the invention may be gained from the attached drawings and the Detailed Description of the Invention that follows.

DETAILED DESCRIPTION OF THE PREFERRED EMBODIMENT

OF THE BEST MODE FOR CARRYING OUT THE INVENTION AS CONTEMPLATED BY THE INVENTORS

Figure 1:
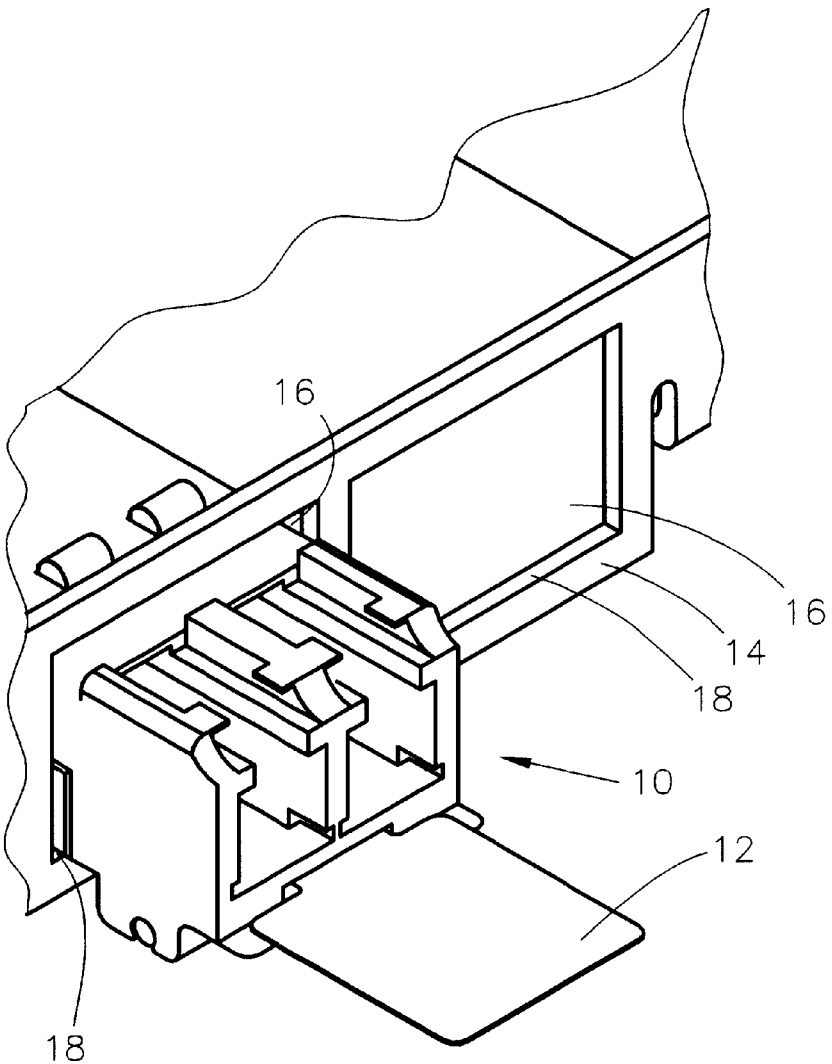
FIG. 1 is an elevated front isometric view of the pull tab and the exposed end of a transceiver module extending from the host electronic system housing.

Initial reference is made to FIG. 1 where transceiver module 10 is illustrated. Extending from the front end of the transceiver module 10 is a pull tab latch control member 12. Pull tab latch control member 12 may be made of a rigid member of plastic or other material or preferably may be of a reinforced flexible material such as a plastic coated fabric or other high strength fiber structure.

Transceiver module 10 is shown projecting from the host electronic housing 14. The host electronic housing 14 is provided with a plurality of holes or ports 16 formed by the host electronic system housing 14 and which provide an edge 18 of the housing 14 which may act as a latch bar 18 for use in retaining the transceiver module 10 mated with the electronics (not shown) within the port 16. Inner surface 15 of system housing 14, in FIG. 2 provides a surface against which the latch surface 32 may engage as will be discussed in more detail below.

Figure 2:
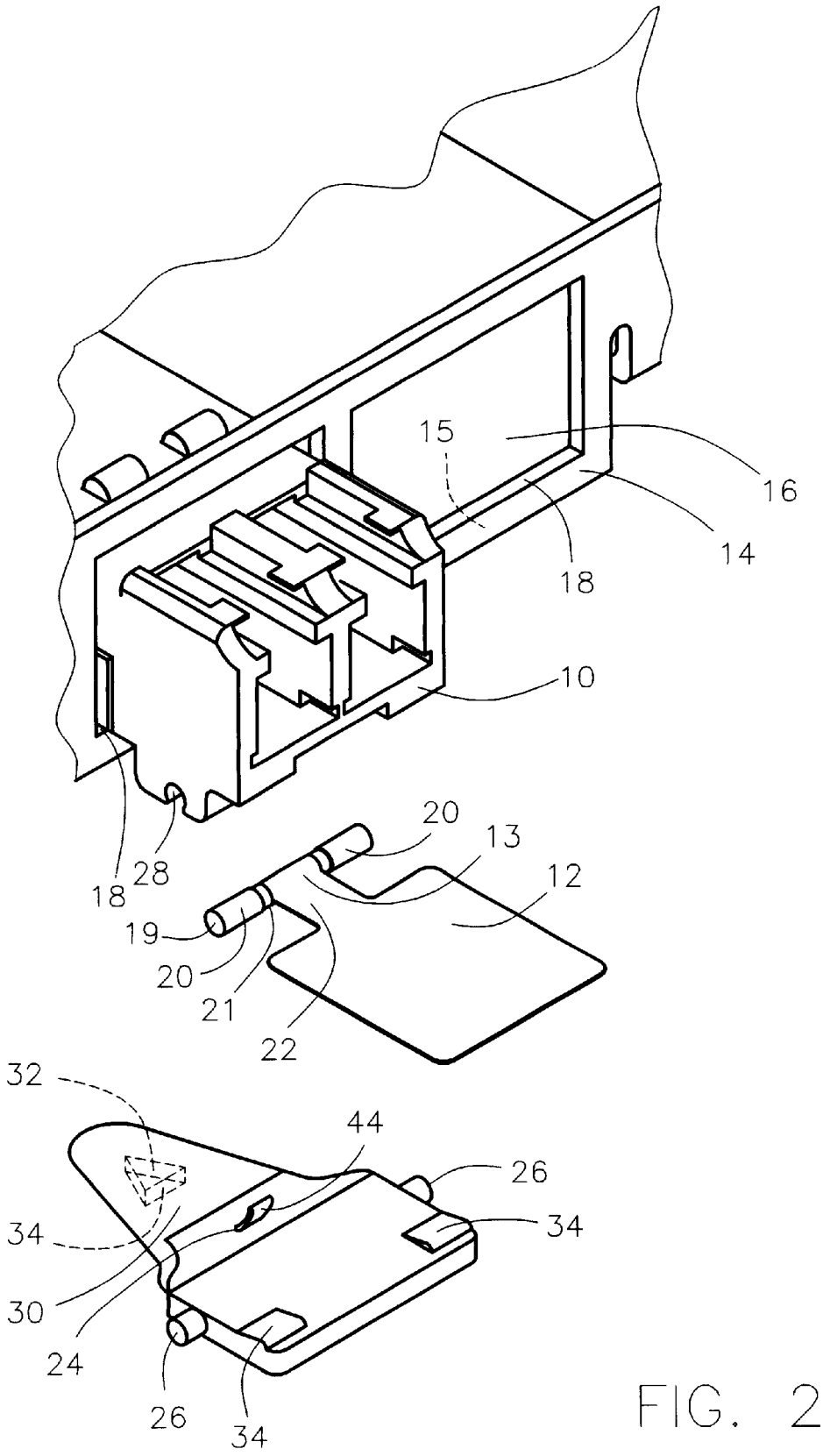
FIG. 2 is an exploded elevated front isometric view of the pull tab and the exposed end of a transceiver module extending from the host electronic system housing with the pull mechanism and the latch arm displaced away from the transceiver module.

Referring to FIG. 2, the transceiver module 10 is shown with the latch control member 12 removed from the transceiver module 10. The latch control actuator 19 is formed as a shaft with enlarged cylindrical end portions 20 and a smaller diameter intermediate shaft 21 interconnecting them. The intermediate shaft 21 is sufficiently small so as to accommodate a loop 13 of the pull tab latch control member 12 to be wrapped around the intermediate shaft 21 and still have an outside dimension smaller than the diameter of the cylindrical end portions 20. The material segment 22 of the pull tab control member 12 is folded around the intermediate shaft 21 and the ends of the material bonded together to form the tab portion 12 which may be flexible and easily gripped by an operator to transmit the pulling action on the tab portion 12 to the latch control actuator 19.

The latch member 24 is provided with a pair of shafts 26 which are snap fitted into the journals 28 of the transceiver module 10. This mounting arrangement not only permits the latch member 24 to pivot with respect to the transceiver module 10 but also to be easily replaceable if broken or damaged.

The latch member 24 is provided with at least one and preferably a pair of ramps or wedges 34 on the surface of the latch member 24 facing the transceiver module 10 and on the opposite end of the latch member 24 from the latch arm 30.

Latch arm 30 further is provided with a latch lug 32 on its outside surface and oriented so that a latching surface 33 is disposable juxtaposed with the inside surface 15 of the electronic system housing 14 and with the latch arm 30 extending into the port 16, thus positioning the latch lug 32 in interference with the inside surface 15 of the electronic system housing 14 whenever pulled without the unlatching of the latch arm 30.

Figure 3:
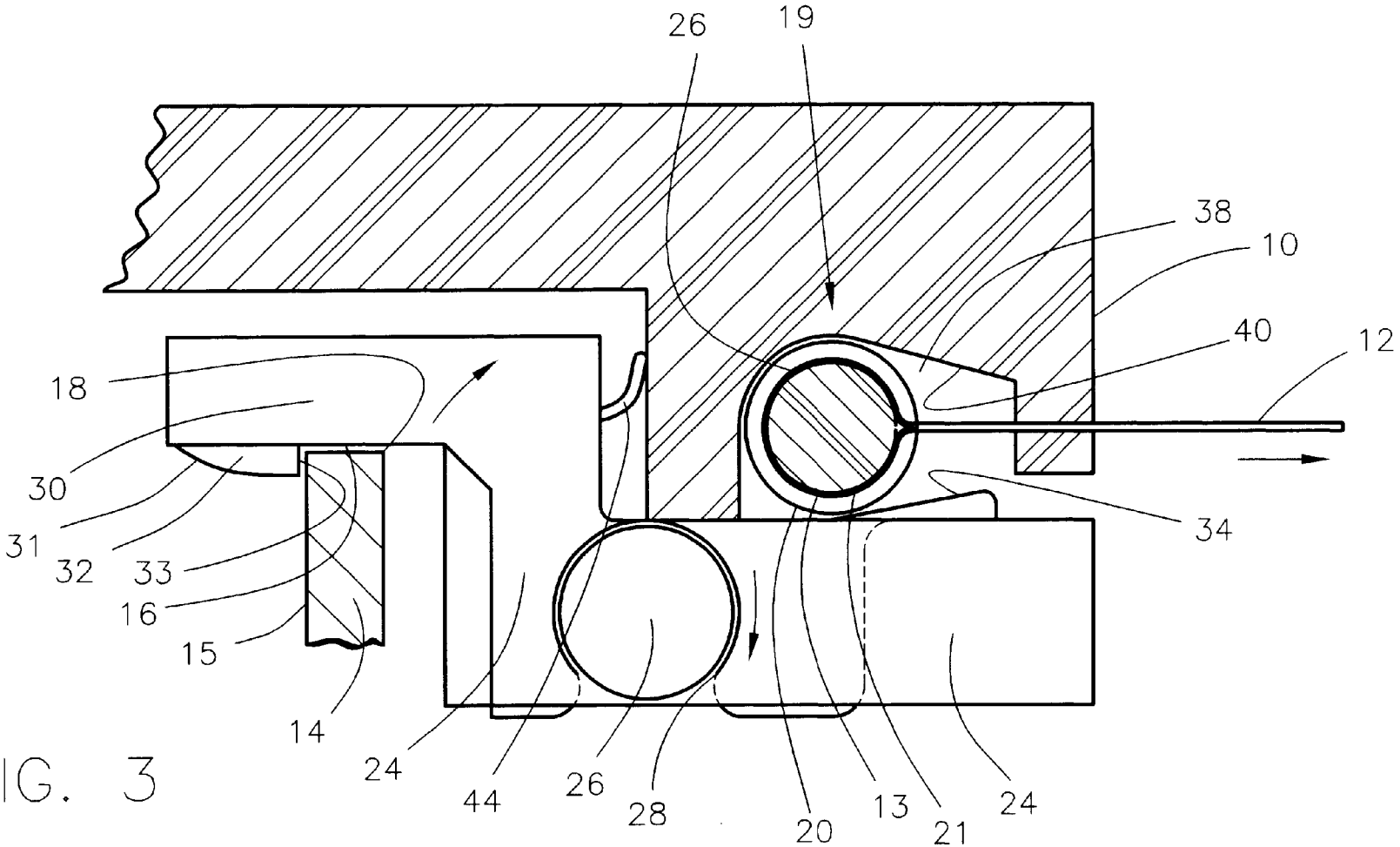
FIG. 3 is a partial side section view of the transceiver module, the pull mechanism and the latch arm engaged with the transceiver housing.

Referring now to FIG. 3 which is a partial section side view of the invention. The left side structure of the transceiver module 10, as shown in FIG. 1, has been removed to expose the interior structure of the transceiver module 10, the latch member 24, the pull tab latch control member 12, and associated latch control actuator 19.

The latch control actuator 19 resides within a chamber 38 formed into the transceiver module 10 and by the input end of the latch member 24. In its operative aspects, the chamber 38 is defined by the ramp 34 on the latch member 24 and ramp 40, which is on the underside of the transceiver module 10 and converges with ramp 34 in the direction of left to right as illustrated in FIG. 3. The chamber 38 is formed to accept and contain the latch control actuator 19 with the latch arm 30 in a restored or latching position, i.e., with the input end elevated and the latch arm 30 depressed to engage the interior surface 15 of housing 14.

Movement of latch actuator 19 in a direction of left to right, as illustrated, and under the influence of the pull tab 12 being pulled outwardly from the transceiver module 10 will cause the cylindrical end portions 20 to engage the ramps 34 and 40. Further movement of the latch actuator 19 causes the ramps 34, 40 to be spread apart one from the other and the latch member 24 to be pivoted about the shafts 26 of latch member 24 and journal 28, thereby raising the latch arm 30 and moving both latch lug 32 and latching surface 36 upward, out of interference with interior surface 15 of housing 14.

Sloped surface 35 of the latch lug 32 is oriented to slide over the edge 18 of port 16, thereby eliminating the need for manually displacing latch lug 32 over edge 18 on insertion of the transceiver module 10 and associated latch arm 30 into port 16.

Figure 4:
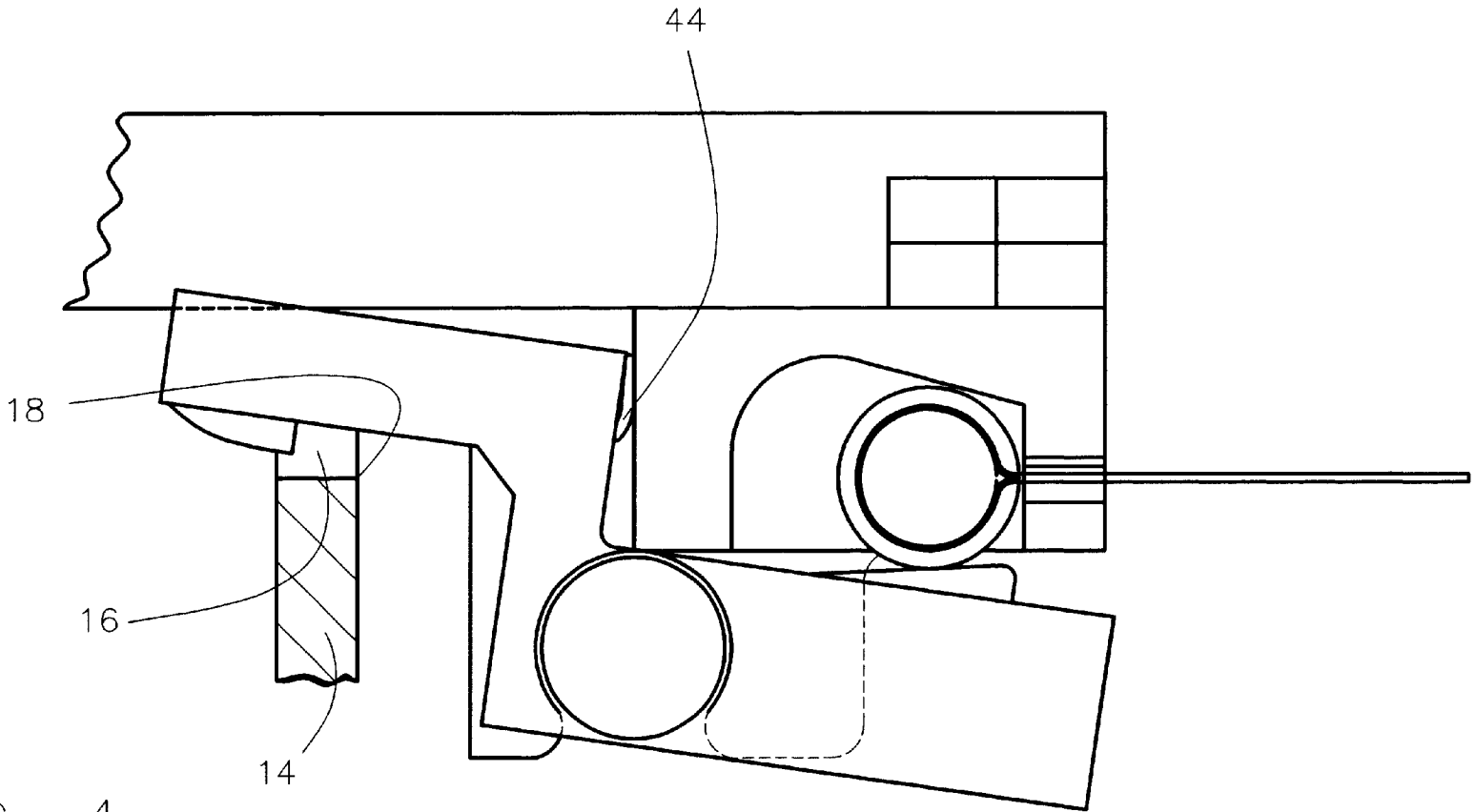
FIG. 4 is a partial side section view of the transceiver module, the pull mechanism and the latch arm represented in the unlatched position of the latch arm and the pull mechanism.

The position of the various parts and members of the invention are illustrated in the unlatched condition in FIG. 4, which is substantially the same as FIG. 3 with the exception of the displacement of the latch actuator 19 and the latch member 30 due to the displacement of the latch actuator 19 as a result of the pulling of the pull tab 12.

Latch member 24 and particularly latch arm 30, which in turn supports latch lug 32, will be pivoted out of the latching position against any bias exerted on latch arm 30 by the engagement of sloping surface 35 of latch lug 32 engaging the edge 18 of system housing 14. When the latch lug 32 so engages the port 16, the latch lug 32 will cam over the edge 18 and then drop behind the housing 14 into the inferring, latching position illustrated in FIG. 3 and thereby retain the transceiver module 10 within port 16 and in connection with the associated electronics (not shown) within port 16 and electronic system housing 14.

The restore action necessary to reposition the latch member 24 for latching is accomplished by relieving the tension on the latch actuator 19 and the restoration of restore spring 44 which is mounted on the latch member 24. The deformation of the restore spring 44 during unlatching by the pivoting of the latch member 24 stores energy in the restore spring 44 and, as permitted to do so, expends that energy to pivot the latch member 24 counterclockwise to a latched position. The restore spring 44 may be disposed on the transceiver module 10 if so desired or may be placed in other positions on the latch arm 30 if space and design constraints dictate.

Figure 5:
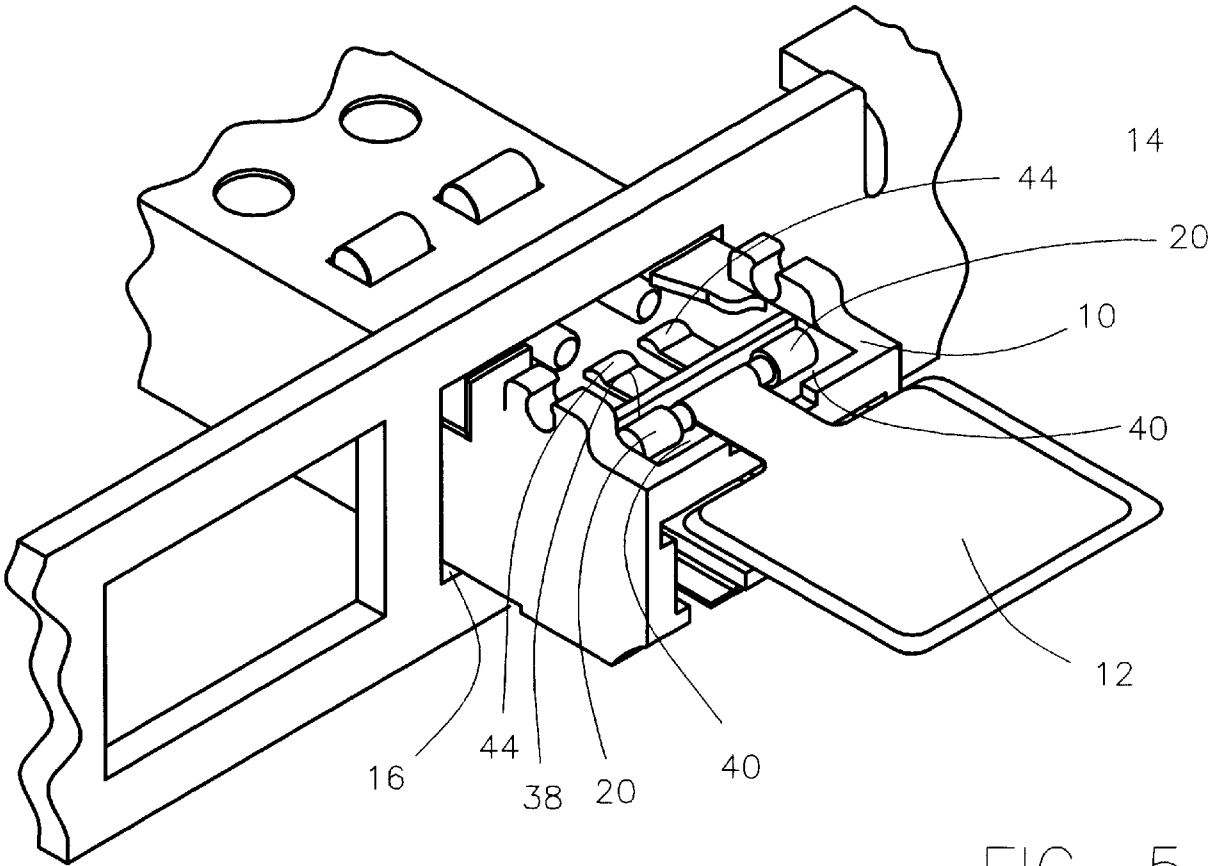
FIG. 5 is a bottom depressed view of the transceiver module assembly, with the latch lever removed and the latch actuator pull tab extending from the transceiver module.

FIG. 5 shows the invention without the latch member 24 installed. The cylindrical end portions 20 of latch actuator 19 overlie the ramp 40 and are resident within chamber 38. Pulling the pull tab 12 will dislocate the latch actuator 19 up the ramp 40 and engage the latch member 24 on its ramps 34 as described earlier. In this view, restore springs 44 are shown as part of the transceiver module 10.

The advantages of this invention are that insertion and latching of the transceiver module 10 within the electronic system housing port 16 is accomplished by merely inserting and pushing the transceiver module 10. The removal of the transceiver module 10 is accomplished by grasping the pull tab 12 and pulling thereon. This not only spreads of the ramps 34, 40 resulting in unlatching but also provides the extraction forces necessary to remove the transceiver module 10 as part of the unlatching and releasing forces or action and does not require repositioning of a hand or fingers in a very limited space. The flexible pull tab 12 is advantageous in that the tab 12 cannot be damaged by bumping or by external forces and the tab 12 may be designed to be large enough to easily grasp yet able to be bent or repositioned out of the way for the insertion of adjacent transceiver modules 10, or insertion of transceiver communications cables and their associated connectors (not shown).

While the description of the invention and its latching action is made with reference to the latching surface 34 engaging inner surface 15 of the bezel 14, it should be understood that the latching surface 34 will perform its retention function equally well if it is engaged with a latch bar which is formed as a part of the member with which the transceiver module 10 mates or a portion of the electromagnetic shield (not shown) substantially surrounding the electronic connectors of the host device (not shown) and the transceiver module 10. The only requirements for the latching surface 34 to perform its retention function is to engage a interfering structure when the transceiver module 10 is pulled or moved in an extracting direction with the latch member 30 remaining in its latching position. Examples of such structures may be found in the related United States Patent Applications list above.

While the description of the invention has been made with reference to a transceiver module for purposes of the preferred embodiment, other non-electronic modules or devices may be latched by the use of this design of latch mechanism.

Each element of the invention is described with reference to at least one figure of the drawings and it should be understood that description is applicable to the same element in any figure notwithstanding a lack of specific reference to the element in a particular figure.

The Detailed Description of the Invention has been made for purposes of disclosure and may not be used to limit in any manner the scope of protection afforded by the attached claims which define the scope of the invention.

This description is made of the preferred embodiment of the invention but other embodiments of and modifications and changes to the described invention will come to mind of one skilled in the art, and the modifications and changes do not remove the resulting article from the scope of protection afforded the invention by the attached claims.

Those of skill in the art will recognize that changes and modifications may be made in the design of the latch mechanism and components thereof without the resulting device being removed from the scope of the invention as defined by the attached claims.

We claim:

1. A pull-to-release latch for latching a module into a mating port, comprising:

a module comprising a frame member, said frame member having a journal disposed to support a latch member;

said latch member having a transverse shaft, said shaft supported in a pivotable manner by said journal of said frame member;

an actuator member engageable with said frame member and said latch member;

said latch member further comprising at least a camming surface on one end of said latch member juxtaposed with a surface of said frame member and a latching end;

said actuator member comprising a portion engageable with said frame member and with said camming surface;

said camming surface on said latch member facing toward said frame member;

said portion of said actuator member disposed for pivotal movement about said shaft and journal from an unactuated position to an actuated position, said actuated position corresponding to a position in which said latch end is displaced toward said frame member to release said module from said port; and said portion of said actuator displaceable intermediate said camming surface and said frame member spreading said camming surface from said frame member, displacing said latch end inwardly to an actuated position, releasing said module from a latched condition relative to said port.

2. The pull-to-release latch of claim 1 wherein said frame comprises at least a wedge projecting from said frame.

3. The pull-to-release latch of claim 1 wherein said latch member is resiliently biased to a latching position.

4. The pull-to-release latch of claim 1 wherein said latch member is pivoted with in said journal with respect to said frame member.

5. The pull-to-release latch of claim 1 wherein said actuator member is displaceable from an unactuated position to an actuated position in a direction aligned with a direction of removal of said module from said port.

6. A pull-to-release latch for latching a module into a mating port, comprising:

a module comprising a frame member, said frame member comprising a journal for supporting a latch member;

said latch member comprising a transverse shaft supported in a pivotable manner by said journal of said frame member;

an actuator member disposed intermediate and engageable with said frame member and said latch member;

said frame member comprising at least a wedge member projecting therefrom;

said latch member disposed juxtaposed with said frame member;

said latch member further comprising at least a wedge member proximate one end of said latch member juxtaposed with at least said wedge member of said frame member and a latching surface on a second end thereof;

said actuator member comprising a portion engageable with said wedge members of said frame member and with said wedge member of said latch member;

said wedge members on both said latch member and said frame member projecting toward each other;

said portion of said actuator member disposed for movement from an unactuated position and an actuated position, said actuated position corresponding to a position in which said latch member is displaced to release said module from said port, and said portion of said actuator displaceable intermediate said wedge members spreading said frame member from said latch member, displacing said latch member to an actuated position, thereby rotating said second end toward said frame member, releasing said module from a latched condition relative to said port.

7. The pull-to-release latch of claim 6 wherein said latch member is resiliently biased to a latching position.

8. The pull-to-release latch of claim 7 wherein said latch member is pivoted in said journal with respect to said frame member.

9. The pull-to-release latch of claim 8 wherein said actuator member is displaceable from an unactuated position to an actuated position in a direction aligned with a direction of removal of said module from said port.

10. A pull-to release latch for latching a module in a port in a host device comprising:

a module having at least a frame, said frame comprising at least one journal;

a latch member moveably disposed on said frame and pivotally supported in said journal, said latch member having a latching end forming a latching surface said latching end movable toward and away from said frame to disengage and engage said latching surface with a retaining surface disposed on said host device and proximate said port and an other end, said other end comprising a camming surface facing said frame; and a manually movable actuator member disposed intermediate said latch member and said frame and displaceable to engage with said frame and engage and displace said camming surface of said latch member relative to said frame thereby displacing said latching end relatively inward toward said frame and away from to said retaining surface effecting disengagement therefrom.

11. The pull-to release latch of claim 10 wherein said module is insertable within and extractable from said port along an axis of movement and said actuator member is displaceable along said axis in a direction of extraction to effect said disengagement.

12. The pull-to release latch of claim 11 wherein at least one of said frame and said latching member comprise at least one surface disposed engageable by said actuator member and disposed to progressively narrow spacing intermediate said frame and said latching member in a region, at least a portion of which is traversed by an engaging portion of said actuator member during displacement in said extracting direction, thereby displacing said other end of said latching member toward said frame and away from a latched position.

13. The pull-to release latch of claim 12 wherein said latching member latching end is biased away from said frame and said other end is biased toward said frame.

14. The pull-to release latch of claim 1 wherein said camming surface is comprised of one surface of a wedge.

* * * * *